US005316539A

United States Patent [19]

Leemhuis et al.

[11] Patent Number: 5,316,539

[45] Date of Patent: May 31, 1994

[54] SELF-ADJUSTING PAPER RECURLER

[75] Inventors: Michael C. Leemhuis, Nicholasville; Daniel J. Westhoff, Georgetown, both of Ky.

[73] Assignee: Lexmark International, Inc., Greenwich, Conn.

[21] Appl. No.: 938,726

[22] Filed: Sep. 1, 1992

[51] Int. Cl.[5] ..... B31B 1/36

[52] U.S. Cl. ..... 493/459; 162/197; 162/271

[58] Field of Search ..... 271/188; 162/197, 271; 355/309; 493/459, 460, 461

[56] References Cited

U.S. PATENT DOCUMENTS

| | | | |
|---|---|---|---|
| 2,531,619 | 11/1950 | Gonia | 92/70 |
| 4,505,695 | 3/1985 | Billings | 493/459 |
| 4,591,259 | 5/1986 | Kuo et al. | 271/188 X |
| 4,977,432 | 12/1990 | Coombs et al. | 162/271 X |
| 5,066,984 | 11/1991 | Coombs | 355/309 |
| 5,104,117 | 4/1992 | McCormick et al. | 493/459 X |
| 5,123,895 | 6/1992 | Mandel | 493/459 |

FOREIGN PATENT DOCUMENTS

| | | | |
|---|---|---|---|
| 2564 | 1/1985 | Japan | 271/188 |
| 31464 | 2/1985 | Japan | 271/188 |
| 6097163 | 5/1985 | Japan . | |
| 267253 | 10/1989 | Japan | 271/188 |
| 152056 | 6/1991 | Japan | 271/188 |

OTHER PUBLICATIONS

Kobus, "Variable Sheet Deflector for Document Retracking", Sep. 1981, Xerox Disclosure Journal, vol. 6, p. 237.

*Primary Examiner*—Robert P. Olszewski
*Assistant Examiner*—Boris Milef
*Attorney, Agent, or Firm*—John A. Brady

[57] ABSTRACT

Lower, arced decurling guide (1) is pivoted on pin (3) and biased upward by spring (7). Upper stop (11) prevents the lower guide from moving closer to upper decurling roller (15). Paper (9) is guided between these upper and lower guides and the lower guide is moved outward in proportion to the rigidity of the paper being decurled. This automatic adjustment provides good decurling for all papers within a broad range of rigidity.

8 Claims, 3 Drawing Sheets

SELF-ADJUSTING PAPER RECURLER

TECHNICAL FIELD

This invention relates to an apparatus to straighten paper which is curled. Paper can be decurled by bending it in a direction opposite from that of the curl and various apparatus exists to guide paper in a bent path for such a purpose. This invention relates to such apparatus having self-adjusting decurl based on the rigidity of the paper.

BACKGROUND OF THE INVENTION

Paper takes on a semi-permanent set or curl by being bent, especially under heat. Other factors, such as printing on one side of paper, may also cause curl. Electrophotographic imaging typically involves bonding toner to paper using heat as a final step in imaging, which results in significant curling. Where the paper is to be conveyed further, such as for duplex printing on the opposite side to the first printing, decurling typically is employed to assure that the paper will feed reliably during the second printing operation.

U.S. Pat. No. 5,066,984 to Coombs teaches a decurler of the general kind in which this invention is employed. That patent employs a stationary guide in the form of in an arc spaced from and partially surrounding a rotating roller. The paper is fed between the guide and the roller, where it is bent around roughly 120 degrees of the roller. The roller is rotated in a direction which assists in paper feeding, but the contact with the roller is light because the space between the guide and the roller is more than the thickness of the paper.

Japanese patent 60-97162 to T. Hashimoto, issued May 30, 1985, discloses a flat guide spaced from pinch rollers for decurling.

The decurler of the foregoing patent 5,066,984 does not provide satisfactory results for papers of different rigidity. Configurations of the arc guide and the spaced roller may be satisfactory for one paper but produce under decurling or over decurling (curling in the direction opposite from the original curling) for other papers. This invention employs self-adjustment of the guide to achieve consistent and highly satisfactory results for papers within a wide range of rigidity.

U.S. Pat. No. 2,531,619 to Gonia discloses a decurler in which decurling is by directing paper around a spring-mounted roller for which the pressure is mechanically adjusted to vary the degree of flexing. This adjustment is done by adjusting screws and is not automatic.

DISCLOSURE OF THE INVENTION

In accordance with this invention, it is recognized that light papers typically require a tighter bend than heavy papers to achieve straightening or sufficient decurl. This invention employs an internal guide surface and outer guide spaced from the internal guide formed in an arc partially around the internal surface. The internal guide may be a roller which is rotated to assist paper feed. The arced guide is pivotally mounted and biased toward the roller and is moved outward by heavier papers being decurled, but not moved or moved less by lighter papers. This movement in proportion to the rigidity of the paper being decurled automatically adjusts the outer guide to the rigidity of the paper being fed to provide good decurling for all papers within a broad range of rigidity.

BRIEF DESCRIPTION OF THE DRAWING

The details of this invention will be described in connection with the accompanying drawing in which.

BEST MODE FOR CARRYING OUT THE INVENTION

Figure 1:
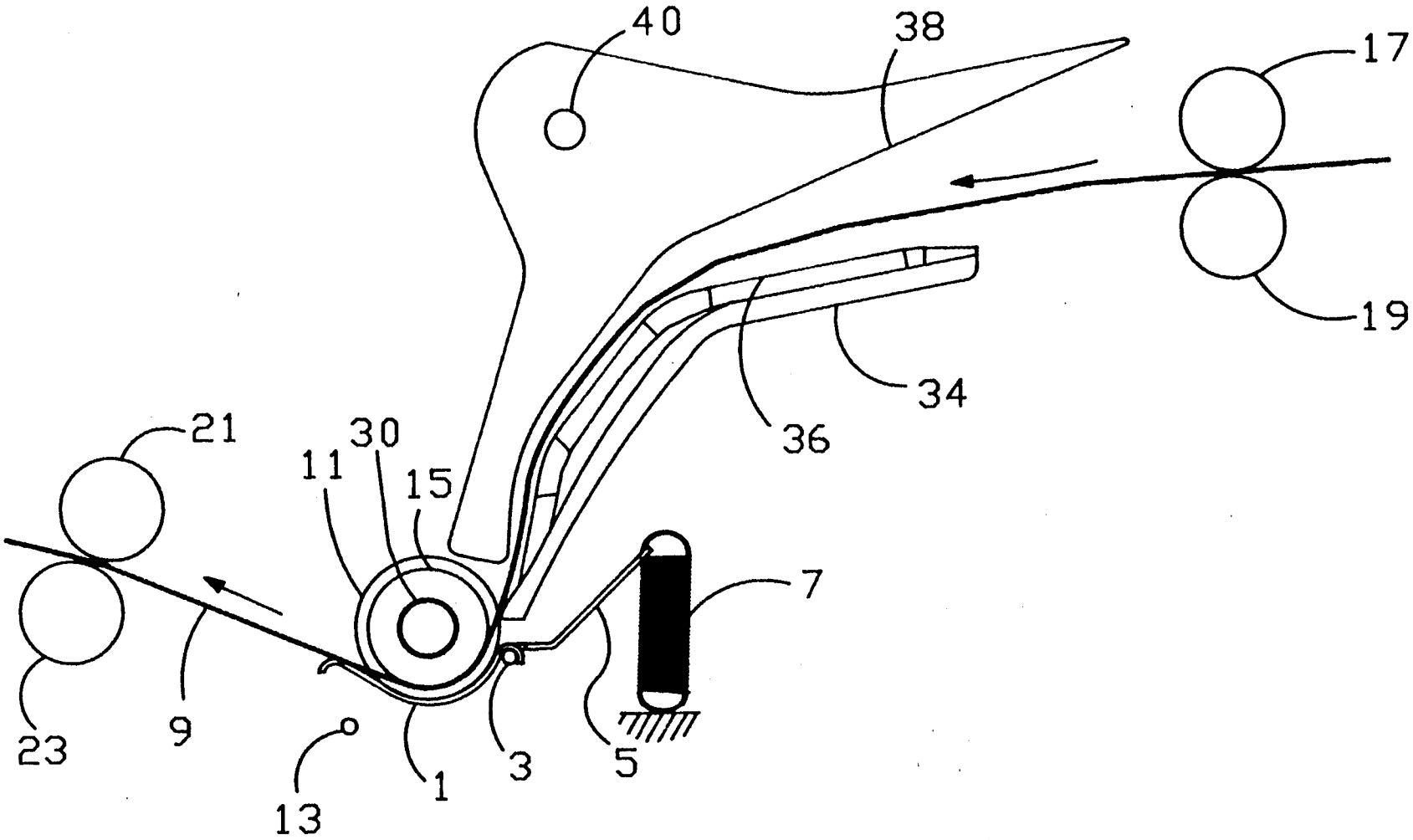
FIG. 1 is an illustrative side view illustrating the decurler mechanisms in their rest or light paper position.

Referring to FIG. 1 the arced, decurl guide 1 is mounted on a pin 3 to pivot around pin 3. An arm 5 of guide 1 is connected through a spring 7 to the frame (a stationary point) of the decurler. Spring 7 biases guide 1 to move clockwise around pin 3.

Figure 2:
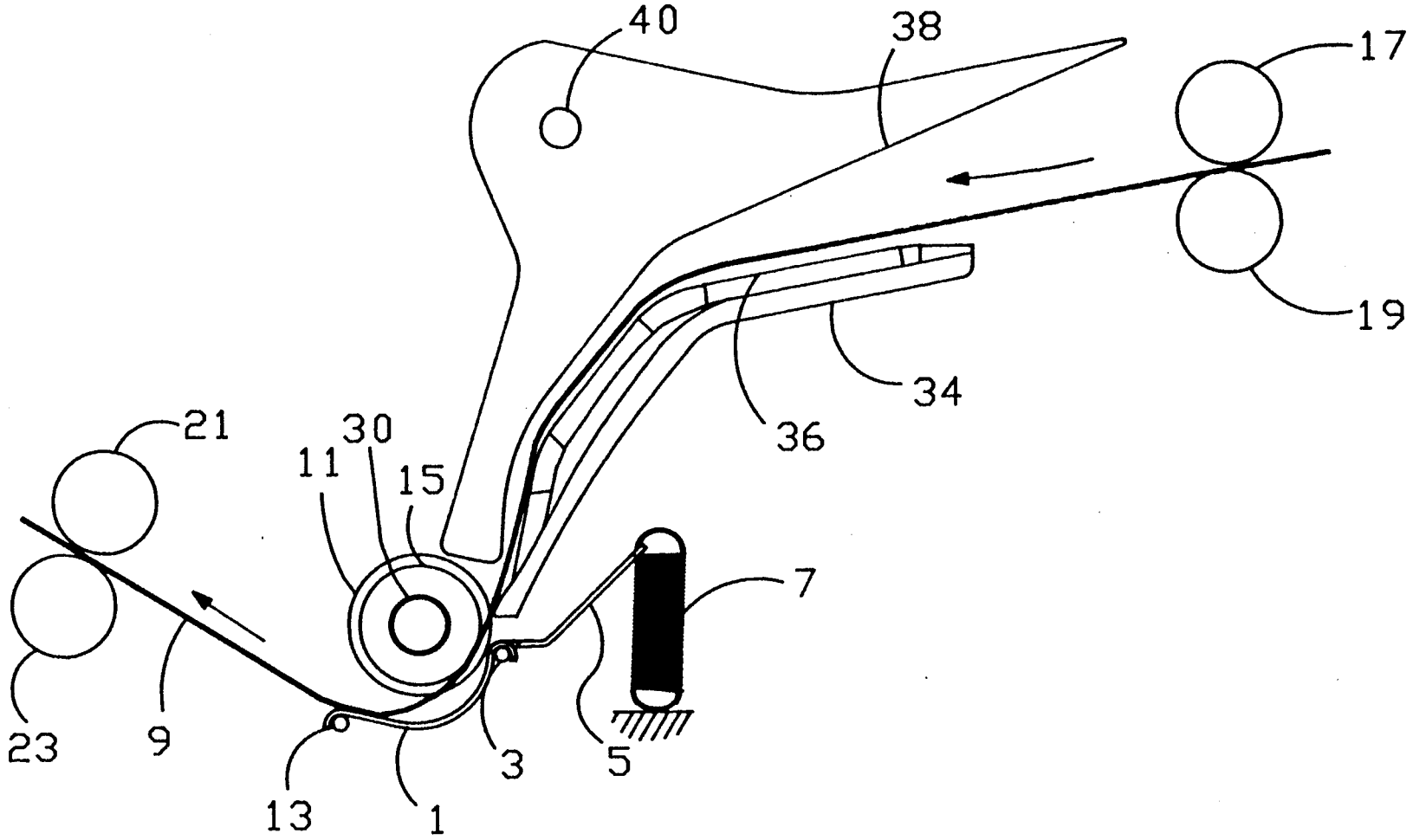
FIG. 2 is the same view as FIG. 1 with a heavy paper pushing the guide downward.

FIG. 1 shows guide 1 contacting a stationary, upper stop surface 11, which is the rest position and the position when the rigidity of a paper 9 being decurled is not sufficient to overcome the bias of spring 7. FIG. 2 shows in guide 1 contacting a stationary, lower stop surface 13, which is the position of guide 1 after the largest movement of guide 1 permitted by the mechanism. Roller 15 is located opposite the arced surface of guide 13, and stop 11 is located to leave a separation of more than the thickness of paper 9 between 15 and guide 13.

The moment (torque characteristics) and other mechanical characteristics of guide 1 as pivoted on pin 3 and resilience and other mechanical characteristics of spring 7 are selected so that paper of number 16 weight (international measure: 60 gr./m$^2$) does not move guide 1, and paper of number 24 weight (90 gr./m$^2$) is just sufficient to move guide 1 against lower stop 13. Pinch rollers 17 and 19 rotate to drive paper 9 between guide 1 and roller 15. Roller 15 is always spaced from guide 1 more than the thickness of any paper to be decurled, and pinch rollers 17 and 19 are on the input side and are positioned close enough to guide 1 so that pinch rollers 17 and 19 are a significant moving force on paper 9 while paper 9 passes between guide 1 and roller 15. Pinch rollers 21 and 23 are on the output side located to grasp any paper 9 of length to be decurled (seven inches or longer in this specific embodiment) before leaving rollers 17 and 19 and pull paper 9 between guide 1 and roller 15. In this manner paper 9 being decurled is initially moved by rollers 17 and 19. The paper 9 is guided to contact roller 15 opposite guide 1, and roller 15 is a urethane, high friction material rotated to assist the paper 9 movement. Before paper 9 exits rollers 17 and 19, it is in the nip of rollers 21 and 23, which turn to continue the movement of paper 9 between guide 1 and roller 15.

Figure 3:
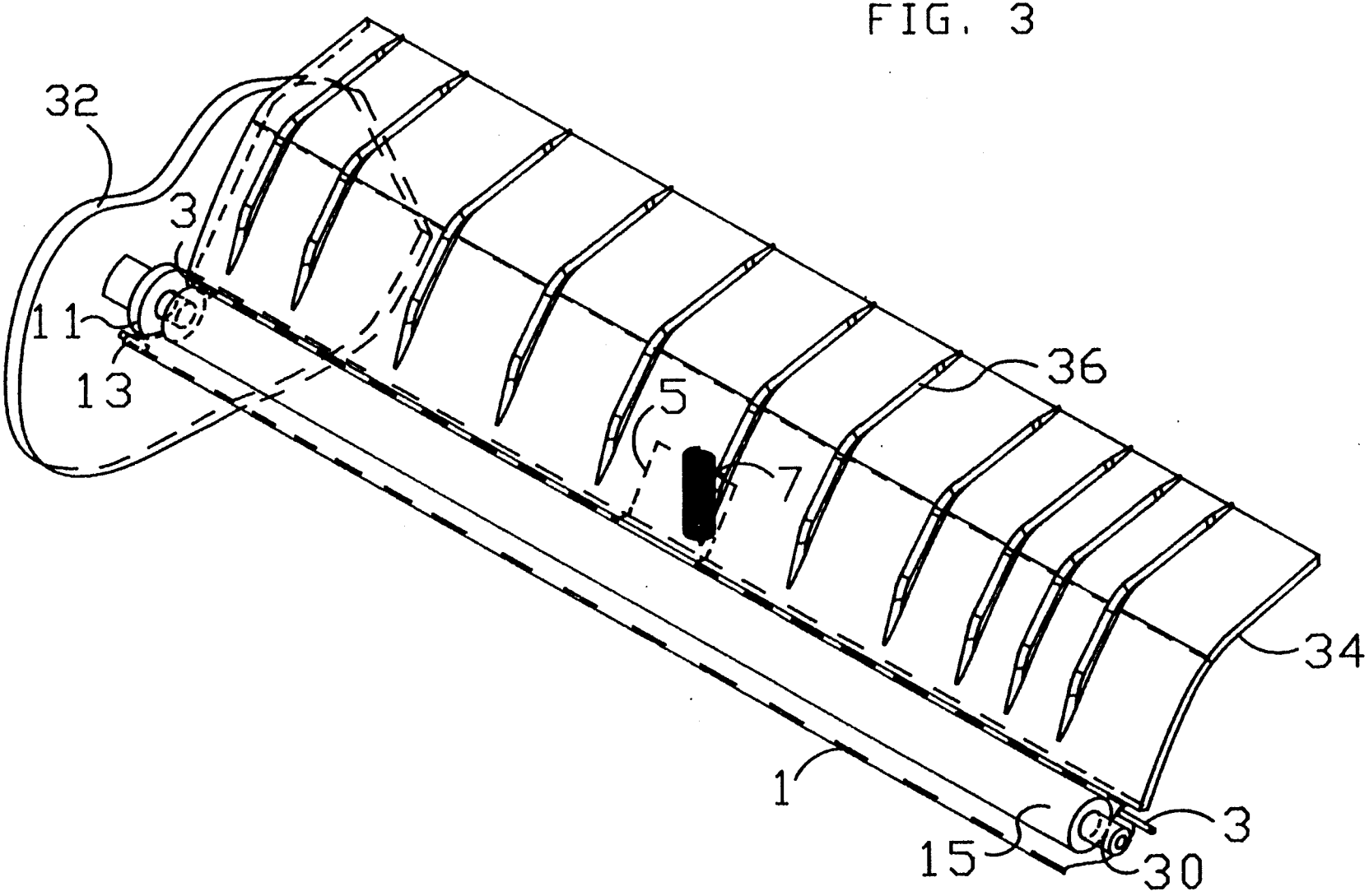
FIG. 3 is a top, perspective view of the primary mechanisms of the decurler of the specific embodiment.

FIG. 3 shows a perspective view of the decurl guide structure of this specific embodiment. The upper stop 11 is implemented by being the outer surface of a low-friction bushing for a shaft 30 (shown on the right without the right bushing) which supports decurl roller 15. Lower stop 13 is a pin mounted on the frame 32 which extends a limited distance to contact guide 1. Although shown on only one side in FIG. 3, upper stop 11 and lower stop 13 are substantially identical on each side of decurl roller 15.

Lower guide 34 extends across the decurler of a width of at least the width of the widest paper 9 to be decurled (almost 9 inches in this specific embodiment; since, when guide 34 is wider than the paper, a skewed paper 9 can pass through without encountering frame 32, which is an advantage).

Lower guide 34 is molded plastic and, as is conventional to reduce electrostatic charging, has a number of raised integral, thin guides 36 on which the paper primarily rests. Reference again to FIG. 1 and FIG. 2 illustrates that guide 36 faces a upper guide 38. Upper guide 38 is pivoted on rod 40 by which in the clockwise position of guide 38 (not shown) paper 9 from rollers 17 and 19 is directed to bypass decurling. In the position shown in FIGS. 1 and 2 upper guide 38 directs paper 9 for decurling and is positioned opposite guides 36 and the lower edge of guide 34 to direct paper 9 to contact decurl roller 15. Ideally, this contact is tangential to roller 15, but a more directed contact is acceptable.

The force from pinch rollers 17 and 19 is not critical to the self-adjustment of this decurler since paper which is not stiff enough to overcome the force from spring 7 will be deflected by guide 1 even if the force from roller 17 and 19 is otherwise large. This stiffness characteristic of paper is sometimes termed beam strength.

Roller 15 has a frictional surface and is driven in the paper feed direction. This facilitates paper movement. Movement of roller 15 is not considered critical to function since it is not the primary drive force during the decurling, and roller 15 ideally might be replaced with a shaped surface of very low drag to paper 9 having a surface complementary to the arc of guide 1. Alternatively, such a stationary surface might be used having significant friction but with feed of paper 11 being assisted by, for example, air jets.

Other variations will be apparent or may be developed in the future which are within the spirit and scope of this invention, with particular reference to the accompanying claims.

We claim:

1. Apparatus for decurling sheet material comprising a pivoting first guide surface in the form of an arc; a second guide surface located opposite said arc of said first guide surface, said arc of said first guide surface being spaced from said second guide surface a distance greater than the thickness of sheet material to be decurled in the unpivoted position of said first guide surface; pivot apparatus integral with the first guide surface to pivot said first guide surface toward and away from said second guide surface, the extreme position toward said second guide surface being said unpivoted position; means biasing said first guide surface to pivot on said pivot apparatus; means to drive said sheet material to first contact said second guide surface and to then move between said first guide surface and said second guide surface; said first guide surface, said pivot apparatus and said biasing means providing resistance to pivoting away from said second guide surface which is overcome in proportion to the rigidity of the sheet material being decurled so that such pivoting is greater with more rigid sheet materials.

2. The decurling apparatus as in claim 1 also comprising a first stop surface and a second stop surface positioned apart to limit pivoting of said first guide surface by obstructing said first guide surface and thereby limit the range of movement of said first guide surface.

3. The decurling apparatus as in claim 2 in which said biasing means comprises a spring, connected across an arm of said first guide surface and a frame of said decurling apparatus.

4. The decurling apparatus as in claim 1 in which said biasing means comprises a spring connected across an arm of said first guide surface and a frame of said decurling apparatus.

5. Apparatus for decurling sheet material comprising a pivoting first guide surface in the form of an arc; a second guide surface located opposite said arc of said first guide surface, said arc of said first guide surface being spaced from said second guide surface a distance greater than the thickness of sheet material to be decurled in the unpivoted position of said first guide surface; at least one pivot pin on which said first guide surface is mounted to move toward and away from said second guide surface; means biasing said first guide surface to pivot on said pivot pin to move said first guide surface toward said second guide surface, the extreme position toward said second guide surface being said unpivoted position; means to drive said sheet material to first contact said second guide surface and to then move between said first guide surface and said second guide surface; said first guide surface and said means biasing providing resistance to said pivoting away from said second guide surface which is overcome in proportion to the rigidity of the sheet material being decurled so that such pivoting is greater with more rigid sheet materials.

6. The decurling apparatus as in claim 5 also comprising a first stop surface and a second stop surface positioned apart to limit pivoting of said first guide surface by obstructing said first guides surface and thereby limit the range of movement of said first guide surface.

7. The decurling apparatus as in claim 6 in which said second guide surface is a roller having a friction surface and which in operation is turned to assist sheet material movement between said first guide surface and said roller.

8. The decurling apparatus as in claim 7 in which said biasing means comprises a spring connected across an arm of said first guide surface and a frame of said decurling.

* * * * *